US007455711B1

(12) United States Patent
Kosco et al.

(10) Patent No.: US 7,455,711 B1
(45) Date of Patent: Nov. 25, 2008

(54) PROCESS FOR MANUFACTURING HARDENED POWDER METAL PARTS

(75) Inventors: John C. Kosco, St. Marys, PA (US); David A. Alven, St. Marys, PA (US)

(73) Assignee: Keystone Investment Corporation, Wilmington, DE (US)

( * ) Notice: Subject to any disclaimer, the term of this patent is extended or adjusted under 35 U.S.C. 154(b) by 4 days.

(21) Appl. No.: 11/454,926

(22) Filed: Jun. 16, 2006

(51) Int. Cl.
*B22F 1/00* (2006.01)
*B22F 3/12* (2006.01)

(52) U.S. Cl. ..... 75/252; 75/255; 419/25; 419/38

(58) Field of Classification Search ..... 75/252, 75/255; 419/25, 38
See application file for complete search history.

(56) References Cited

U.S. PATENT DOCUMENTS 3,837,845 A 9/1974 Church
4,363,662 A 12/1982 Takahashi et al. ..... 75/243
4,803,409 A 2/1989 Horikawa ..... 318/310
5,286,275 A * 2/1994 Murakami et al. ..... 75/252
5,682,588 A * 10/1997 Tsutsui et al. ..... 419/11
6,068,813 A * 5/2000 Semel ..... 419/66
6,652,618 B1 * 11/2003 Unami et al. ..... 75/252

* cited by examiner

*Primary Examiner*—Roy King
*Assistant Examiner*—Ngoclan T Mai
(74) *Attorney, Agent, or Firm*—Alvin T. Rockhill

(57) ABSTRACT

The subject invention reveals a process for making hardened powder metal parts which comprises compacting a powder metal composition into a green preformed metal part and subsequently sintering said green metal part to produce the powder metal part at an elevated temperature and subsequently cooling the sintered part at a rate which is sufficient to insure the formation of a substantial amount of martensite, wherein the powder metal composition is comprised of copper powder, a nickel powder and a base iron powder wherein said composition contains from about 1 weight percent to about 5 weight percent of the total sum of said copper powder and said nickel powder and wherein the ratio of the nickel powder to the copper powder is within the range of 1:1 to 9:1, and wherein the balance of said composition constitutes iron.

17 Claims, 1 Drawing Sheet

PROCESS FOR MANUFACTURING HARDENED POWDER METAL PARTS

BACKGROUND OF THE INVENTION

Powder metal parts are made by first compacting a metal powder composition into a desired shape in a die to produce a green metal part. The green metal part is then sintered at an elevated temperature to produce the powder metal part. Powder metal parts offer the advantage of being able to be formed into parts having intricate designs that frequently cannot be made by casting, forging or machining. In such applications, powder metal parts can typically be made at a reduced cost as compared to parts of similar design wherein machining is required. Accordingly, for economic and practical reasons, powdered metal parts are commonly used in a wide variety of applications.

Copper is frequently added to the metal powder utilized in making powder metal parts to promote rapid hardening during the cooling step as the powdered metal part is cooled after being sintered. However, the presence of copper in the metal composition causes the part to expand during sintering and leads to a significant variation in the tolerance of parts produced. In other words, the presence of copper makes it difficult to control the size and uniformity of such powder metal parts. This problem becomes more pronounced in the case of larger parts. For instance, it is typical for powder metal parts containing copper to expand from 0.002 to 0.005 inches per inch of part diameter.

U.S. Pat. No. 3,837,845 discloses a steel powder particularly adapted for use in powder forging and having a composition consisting of about 0.05-0.15% carbon, about 0.8-2.5% silicon, up to less than 1% manganese, about 0.5-4% nickel, about 0.2-2% molybdenum, up to about 0.2% columbium, up to 2% copper, about 0.01-0.25% oxygen, the balance being essentially iron (see claim 1).

U.S. Pat. No. 4,363,662 discloses an abrasion resistant ferro-based sintered alloy comprising 1.1-1.6% carbon, 1.5-3.5% chromium, 1.6-2.9% molybdenum, 1.0-3.0% nickel, 3.0-5.0% cobalt, 0.5-1.5% tungsten, 1.8-18.0% copper and balance iron (see claim 1)

U.S. Pat. No. 4,803,409 discloses an alloy steel powder for powder metal applications, the powder including 0.2-2.0% tungsten, 0.8-3.0% nickel, 0.2-2.0% copper, and the balance substantially iron (see col. 2, lines 30-34).

There is a need for a technique for manufacturing hardened powder metal parts that are uniform and of consistent shape. However, heretofore the inclusion of copper in such parts to attain desired levels of hardness has not been possible without compromising part tolerances and uniformity. In the case of many parts such a compromise cannot be tolerated.

SUMMARY OF THE INVENTION

This invention is based upon the discovery that a small amount of nickel powder can be added to iron based powder metal compositions that contain copper to attain a higher degree of hardness during cooling after being sintered without causing unacceptable levels of part expansion and loss of uniformity. The powder metal compositions used in making such parts will typically contain a total sum of about 1 weight percent to 5 weight percent copper powder and nickel powder. The ratio of nickel powder to copper powder in such compositions will typically be within the range of 1:1 to 9:1.

The present invention more specifically discloses a powdered metal composition which is comprised of a copper powder, a nickel powder and a base iron powder, wherein the base iron powder contains 0 weight percent to 2 weight percent nickel, wherein the base iron powder contains 0.1 weight percent to 0.6 weight percent molybdenum, wherein the total sum of said copper powder and nickel powder in the powdered metal composition is within the range of 1.5 weight percent to 3 weight percent, and wherein the ratio of the nickel powder to the copper powder is within the range of 6:1 to 9:1, and wherein the balance of said composition constitutes iron.

The subject invention also reveals a process for making a powder metal article which comprises compacting a powder metal composition into a green preformed metal part and subsequently sintering said green metal part to produce the powder metal part at an elevated temperature and subsequently cooling the sintered part at a rate which is sufficient to insure the formation of a substantial amount of martensite, wherein the powder metal composition is comprised of copper powder, a nickel powder and a base iron powder wherein said composition contains from about 1 weight percent to about 5 weight percent of the total sum of said copper powder and said nickel powder and wherein the ratio of the nickel powder to the copper powder is within the range of 1:1 to 9:1, and wherein the balance of said composition constitutes iron.

DETAILED DESCRIPTION OF THE INVENTION

Figure 1:
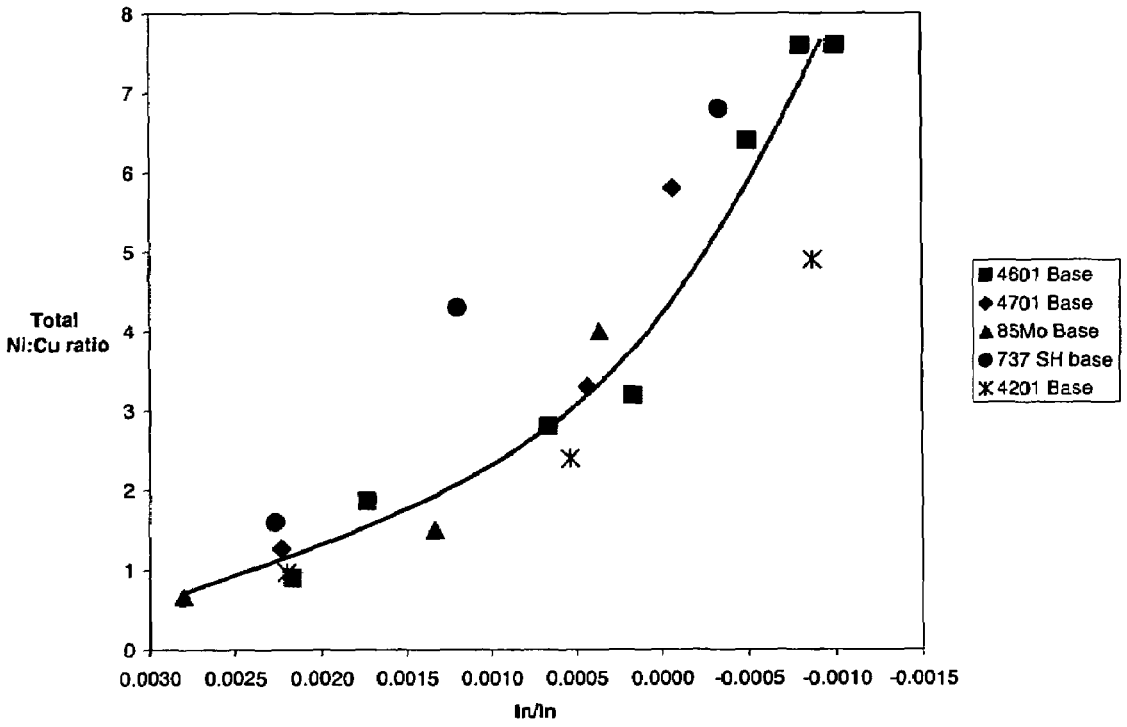
FIG. 1 is a graph showing the relationship between dimensional changes as a function of the nickel to copper ratio for various base iron alloy powders.

Powder metal articles are manufactured utilizing the process of this invention by placing a metal powder composition into a mold and subsequently compacting the metal powder in the mold under a high pressure which is typically within the range of 20 tsi to 70 tsi (tons per square inch). This results in the formation of an uncured or green metal part. The green part is then cured or sintered by heating in a sintering furnace, such as an electric or gas-fired belt or batch sintering furnace, for a predetermined time at high temperature in an inert environment. Nitrogen, vacuum and Nobel gases, such as helium or argon, are examples of such inert protective environments. Metal powders can be sintered in the solid state with bonding by diffusion rather than melting and re-solidification. Also, sintering may result in a decrease in density depending on the composition and sintering temperature.

Typically, the sintering temperature utilized will be about 60% to about 90% of the melting point of the metal composition being employed. The sintering temperature will normally be in the range of 1500° F. (816° C.) to 2450° F. (1343° C.). The sintering temperature for iron based compacts will more typically be within the range of 2000° F. (1093° C.) to about 2400° F. (1316° C.). The sintering temperature utilized with copper systems will, of course, be considerably lower due to the lower melting point of copper. In any case, the appropriate sintering temperature and time-at-temperature will depend on several factors, including the chemistry of the metallurgical powder, the size and geometry of the compact, and the heating equipment used. Those of ordinary skill in the art may readily determine appropriate parameters for the molding steps to provide a green preform of suitable density and geometry which is then placed into a furnace at 2000° F.-2450° F. for approximately 30 minutes in a protective atmosphere to sinter the metal.

The final density of the part will vary widely depending on its composition and the particular pressing and sintering parameters employed. The average density of a green preform formed from an iron-base metallurgical powder typically is in the range of 6.2 to 7.2 g/cc and may be, for example, 6.8 g/cc. The density of the part can also be expressed as a percentage of the theoretical density of the composition.

The base metal powders that can be utilized in manufacturing powder metal parts are typically a substantially homogenous powder including a single alloyed or unalloyed metal powder or a blend of one or more such powders and, optionally, other metallurgical and non-metallurgical additives such as, for example, lubricants. Thus, "metallurgical powder" may refer to a single powder or to a powder blend. There are three conventional types of base metal powders used to make powder metal mixes and parts. The most common base metal powders are homogeneous elemental powders such as iron, copper, nickel and molybdenum. These are blended together, along with additives such as lubricants and graphite, and molded as a mixture. A second possibility is to use pre-alloyed powders, such as an iron-nickel-molybdenum steel. In this case, the alloy is formed in the melt prior to atomization and each powder particle is a small ingot having the same composition as the melt. Again, additives of graphite, lubricant and elemental powders may be added to make the mix. A third type is known as "diffusion bonded" powders. In this case, an elemental powder, such as iron, is mixed with a second elemental powder or oxide of a powder, and is subsequently sintered at low temperatures so partial diffusion of the powders occurs. This yields a powder with fairly good compressibility which shows little tendency to separate during processing. While iron is the most common metal powder, powders of other metals such as aluminum, copper, tungsten, molybdenum and the like may also be used. Also, as used herein, an "iron metal powder" is a powder in which the total weight of iron and iron alloy powder is at least 50 percent of the powder's total weight. While more than 50% of the part's composition is iron, the powder may include other elements such as carbon, sulfur, phosphorus, manganese, molybdenum, silicon, and chromium. Copper and nickel can also optionally be present in pre-alloyed base metal powder compositions. Typically, the base metal powder will contain at least 95 weight percent iron and will preferably contain at least 97 weight percent iron.

At least four types of metallic iron powders are available. Electrolytic iron, sponge iron, carbonyl iron and nanoparticle sized iron are made by a number of processes. Electrolytic iron is made via the electrolysis of iron oxide, and is available in annealed and unannealed form from, for example, OM Group, Inc., which is now owned by North American Höganäs, Inc. Sponge iron is also available from North American Höganäs, Inc. There are at least two types of sponge iron: hydrogen-reduced sponge iron and carbon monoxide-reduced sponge iron. Carbonyl iron powder is commercially available from Reade Advanced Materials. It is manufactured using a carbonyl decomposition process.

Depending upon the type of iron selected, the particles may vary widely in purity, surface area, and particle shape. The following non-limiting examples of typical characteristics are included herein to exemplify the variation that may be encountered. Electrolytic iron is known for its high purity and high surface area. The particles are dendritic. Carbonyl iron particles are substantially uniform spheres, and may have a purity of up to about 99.5 percent. Carbon monoxide-reduced sponge iron typically has a surface area of about 95 square meters per kilogram ($m^2$/kg), while hydrogen-reduced sponge iron typically has a surface area of about 200 $m^2$/kg. Sponge iron may contain small amounts of other elements, for example, carbon, sulfur, phosphorus, silicon, magnesium, aluminum, titanium, vanadium, manganese, calcium, zinc, nickel, cobalt, chromium, and copper. Additional additives may also be used in molding the part.

The powder metal compositions utilized in the practice of this invention will contain the desired base metal powder and a total quantity of copper powder and nickel powder of 1 weight percent to 5 weight percent. These powder metal compositions will typically contain a total sum of copper powder and nickel powder of 1.5 weight percent to 4 weight percent. These powder metal compositions will more typically contain a total sum of copper powder and nickel powder of 1.5 weight percent to 3 weight percent. For instance, the powder metal composition could hypothetically contain 0.75 weight percent copper and 0.75 weight percent nickel (1.5 weight percent total copper and nickel).

The weight ratio of the nickel powder to copper powder in such compositions will typically be within the range of 1:1 to 9:1. The ratio of nickel powder to copper powder will more typically be within the range of 2.5:1 to 8:1. The ratio of nickel powder to copper powder will more preferably be within the range of 3:1 to 6:1. It should be noted that the nickel and copper are present in the powder metal compositions of this invention either as separate powders or as pre-alloyed compositions. In other words, the powder metal compositions of this invention are comprised of a base metal powder, the copper powder, and the nickel powder.

Articles made by this process typically exhibit a Rockwell C hardness of greater than 25 and a size change on tempering after being sintered within −0.001 to 0.001 inches per inch of part diameter. Articles made utilizing the process of this invention will more typically have a Rockwell C hardness of at least 30. The part will preferably expand or contract by less than 0.0005 inches per inch of part diameter after tempering.

This invention is illustrated by the following examples that are merely for the purpose of illustration and are not to be regarded as limiting the scope of the invention or the manner in which it can be practiced. Unless specifically indicated otherwise, parts and percentages are given by weight.

EXAMPLE 1

In this series of experiments, powder metal parts were manufactured utilizing the powder metal composition and technique of this invention and compared to powder metal parts made by conventional means. Several base iron alloys were utilized in this series of experiments and are listed in Table 1.

TABLE 1

Chemical Composition of the base irons used

| | Chemical composition (wt %) | | |
|---|---|---|---|
| Base iron | Ni | Mo | Fe |
| 4601 | 1.8 | 0.55 | Balance |
| 4701 | 0.9 | 1.0 | Balance |
| 4201 | 0.45 | 0.6 | Balance |
| 85 Mo | 0 | 0.85 | Balance |
| Ancorsteel 737 SH | 1.4 | 1.25 | Balance |

These base alloys were then admixed with elemental Ni, Cu, and 0.9 wt % graphite additions utilizing standard techniques for mixing powdered metals. The compositions of the powdered materials tested are shown in Table 2.

TABLE 2

Chemical Composition of the Powdered Materials Tested

| Material | Base | Admixed amount (weight %) Ni | Cu | Total Ni:Cu ratio |
|---|---|---|---|---|
| A | 4601 | 0 | 2 | 0.9 |
| B | 4601 | 1 | 1.5 | 1.87 |
| C | 4601 | 1 | 1 | 2.8 |
| D | 4601 | 1.5 | 1 | 3.2 |
| E | 4601 | 1.5 | 0.5 | 6.4 |
| F | 4601 | 2 | 0.5 | 7.6 |
| G | 4701 | 1 | 1.5 | 1.27 |
| H | 4701 | 0.75 | 0.5 | 3.3 |
| I | 4701 | 2 | 0.5 | 5.8 |
| J | 85 Mo | 1 | 1.5 | 0.67 |
| K | 85 Mo | 0.75 | 0.5 | 1.5 |
| L | 85 Mo | 2 | 0.5 | 4 |
| M | 737 SH | 1 | 1.5 | 1.6 |
| N | 737 SH | 0.75 | 0.5 | 4.3 |
| O | 737 SH | 2 | 0.5 | 6.8 |
| P | 4201 | 1 | 1.5 | 0.97 |
| Q | 4201 | 0.75 | 0.5 | 2.4 |
| R | 4201 | 2 | 0.5 | 4.9 |

These powder metal compositions were then compacted into green preformed parts and sintered utilizing standard techniques for making powdered metal parts. The Rockwell C hardness (RC) and the change in part size as measured from molding die size measured after being sintered, cooled and tempered is reported in Table 3.

TABLE 3

| Material | Hardness (HRC) | Dimensional change (in) | Total Ni:Cu ratio |
|---|---|---|---|
| A | 38 | 0.0022 | 0.9 |
| B | 38 | 0.0017 | 1.87 |
| C | 39 | 0.0007 | 2.8 |
| D | 38 | 0.0002 | 3.2 |
| E | 39 | −0.0005 | 6.4 |
| F | 39 | −0.0010 | 7.6 |
| G | 38 | 0.0022 | 1.27 |
| H | 39 | 0.0004 | 3.3 |
| I | 40 | −0.0001 | 5.8 |
| J | 34 | 0.0028 | 0.67 |
| K | 25 | 0.0013 | 1.5 |
| L | 33 | 0.0004 | 4 |
| M | 37 | 0.0023 | 1.6 |
| N | 40 | 0.0012 | 4.3 |
| O | 38 | −0.0003 | 6.8 |
| P | 35 | 0.0022 | 0.97 |
| Q | 25 | 0.0005 | 2.4 |
| R | 35 | −0.0009 | 4.9 |

EXAMPLE 2

In this series of experiments, powder metal parts were manufactured utilizing the powder metal composition and technique of this invention and compared to powder metal parts made by conventional means. The base iron alloy powder utilized in this series of experiments was 4600 steel that contained 1.8 weight percent nickel and 0.5 weight percent molybdenum with the balance of the metal composition being iron. These base alloys were then admixed with elemental Ni, Cu, and graphite additions utilizing standard techniques for mixing powdered metals. The compositions of the powdered materials tested are shown in Table 4.

TABLE 4

Chemical Composition of the base irons used

| Material | Amount admixed (weight %) Ni | Cu | Graphite |
|---|---|---|---|
| S | 0.75 | 0.5 | 0.8 |
| T | 0.75 | 0.5 | 1.0 |
| U | 0 | 2.5 | 0.8 |
| V | 0 | 2.5 | 1.0 |

These powder metal compositions were then compacted into green preformed parts and sintered utilizing standard techniques for making powdered metal parts. The Rockwell C hardness (RC) and the change in part size as measured from molding die size measured after being sintered, cooled and tempered is reported in Table 5.

TABLE 5

| Material | Hardness (HRC) | Dimensional change (in) | Density (g/cc) |
|---|---|---|---|
| S | 36 | 0.0001 | 7.0 |
| T | 40 | −0.0001 | 7.0 |
| U | 39 | 0.0035 | 7.0 |
| V | 38 | 0.0013 | 7.0 |

It should be noted that the variation in dimensional change, due to the different levels of graphite added, after being sintered, cooled, and tempered was much less in the case of the parts that were made with the powder metal compositions of this invention that contained both a copper powder and a nickel powder.

EXAMPLE 3

In this series of experiments, powder metal parts were manufactured utilizing the powder metal composition and technique of this invention and compared to powder metal parts made by conventional means. The base iron alloy powder utilized in this series of experiments was 4600 steel that contained 1.8 weight percent nickel and 0.5 weight percent molybdenum with the balance of the metal composition being iron. These base alloys were then admixed with elemental Ni and Cu in a ratio of 6.4:1, and 0.9 weight percent graphite additions utilizing standard techniques for mixing powdered metals. These powder metal compositions were then compacted into green preformed parts at 40, 50, and 60 tsi, and sintered utilizing standard techniques for making powdered metal parts. The Rockwell C hardness (RC) and the change in part size as measured from molding die size measured after being sintered, cooled and tempered is reported in Table 6.

TABLE 6

| Material | Hardness (HRC) | Dimensional change (in) | Density (g/cc) |
|---|---|---|---|
| W | 35 | −0.0010 | 6.8 |
| X | 38 | −0.0005 | 7.0 |
| Y | 42 | 0.0008 | 7.1 |

It should be noted that the variation in dimensional change, due to the variation in density, after being sintered, cooled, and tempered was held within ±0.001 inches with the powder metal compositions of this invention that contained both a copper powder and a nickel powder.

While certain representative embodiments and details have been shown for the purpose of illustrating the subject invention, it will be apparent to those skilled in this art that various changes and modifications can be made therein without departing from the scope of the subject invention.

What is claimed is:

1. A powdered metal composition which is comprised of a copper powder, a nickel powder and a base iron powder, wherein the base iron powder contains 0 weight percent to 2 weight percent nickel, wherein the base iron powder contains 0.1 weight percent to 0.6 weight percent molybdenum, wherein the total sum of said copper powder and said nickel powder in the powdered metal composition is within the range of 1.5 weight percent to 3 weight percent, and wherein the ratio of the nickel powder to the copper powder is within the range of 6:1 to 9:1, and wherein the balance of said composition constitutes iron.

2. A powder metal composition as specified in claim 1 wherein the base iron powder is further comprised of from 0.1 to 0.5 weight percent of molybdenum.

3. A powder metal composition as specified in claim 1 wherein the base metal powder contains at least 95 weight percent iron.

4. A powder metal composition as specified in claim 2 wherein the base metal powder contains at least 97 weight percent iron.

5. A powder metal composition as specified in claim 1 wherein the base metal composition is further comprised of carbon.

6. A powder metal composition as specified in claim 5 wherein the base metal composition is further comprised of sulfur.

7. A powder metal composition as specified in claim 5 wherein the base metal composition is further comprised of phosphorus.

8. A powder metal composition as specified in claim 5 wherein the base metal composition is further comprised of at least one metal selected from the group consisting of magnesium, aluminum, titanium, vanadium, manganese, calcium, zinc, cobalt, and chromium.

9. A process for making a powder metal article which comprises compacting a powder metal composition into a green preformed metal part and subsequently sintering said green metal part to produce the powder metal part at an elevated temperature and subsequently cooling the sintered part at a rate which is sufficient to insure the formation of a substantial amount of martensite, wherein the powder metal composition is comprised of a copper powder, a nickel powder and a base iron powder, wherein the base iron powder contains 0 weight percent to 2 weight percent nickel, wherein the total sum of said copper powder and said nickel powder in the powdered metal composition is within the range of 1.5 weight percent to 3 weight percent, and wherein the ratio of the nickel powder to the copper powder is within the range of 6:1 to 9:1, and wherein the balance of said composition constitutes iron.

10. A process as specified in claim 9 wherein the powder metal composition is compacted under a pressure of 20 tsi to 70 tsi to produce the green preformed metal part.

11. A process as specified in claim 10 wherein the green preformed metal part is sintered at a temperature which is within the range of 1500° F. to 2450° F.

12. A process as specified in claim 10 wherein the green preformed metal part is sintered at a temperature which is within the range of 2000° F. to 2400° F.

13. A process as specified in claim 11 wherein the powder metal part produced has a Rockwell C hardness of at least 25.

14. A process as specified in claim 11 wherein the powder metal part produced has a Rockwell C hardness of at least 30.

15. A process as specified in claim 11 wherein the base iron powder is further comprised of 0.1 to 0.6 weight percent of molybdenum.

16. A process as specified in claim 11 wherein the base iron powder is further comprise of 0.1 to 0.5 weight percent of molybdenum.

17. A process as specified in claim 11 wherein the ratio of the nickel powder to the copper powder is within the range of 6:1 to 8:1.

* * * * *